US007516951B2

(12) United States Patent
Hashimoto et al.

(10) Patent No.: US 7,516,951 B2
(45) Date of Patent: Apr. 14, 2009

(54) PAPER FEEDER AND IMAGE FORMING APPARATUS

(75) Inventors: Susumu Hashimoto, Katsuragi (JP); Toshiki Ohgita, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 322 days.

(21) Appl. No.: 11/302,349

(22) Filed: Dec. 14, 2005

(65) Prior Publication Data

US 2006/0125172 A1 Jun. 15, 2006

(30) Foreign Application Priority Data

Dec. 15, 2004 (JP) ..... 2004-362097

(51) Int. Cl.
*B65H 3/44* (2006.01)

(52) U.S. Cl. ..... 271/9.09; 271/9.01; 271/9.11; 271/9.13

(58) Field of Classification Search ..... 271/9.01, 271/9.09, 9.11, 9.13, 264, 65, 291; 399/391, 399/392, 401, 405
See application file for complete search history.

(56) References Cited

U.S. PATENT DOCUMENTS

| | | | | |
|---|---|---|---|---|
| 4,853,740 | A * | 8/1989 | Ushio et al. | 399/402 |
| 5,155,540 | A * | 10/1992 | Yamada et al. | 399/402 |
| 5,517,295 | A * | 5/1996 | Kaneko et al. | 399/373 |
| 5,528,353 | A * | 6/1996 | Ushio et al. | 399/364 |
| 5,680,651 | A * | 10/1997 | Tsuji et al. | 399/401 |
| 6,055,410 | A * | 4/2000 | Marumoto et al. | 399/392 |
| 6,629,795 | B2 * | 10/2003 | Kinoshita et al. | 400/582 |
| 6,681,096 | B2 * | 1/2004 | Seto et al. | 399/388 |
| 6,944,411 | B2 * | 9/2005 | Iseki | 399/80 |
| 7,315,709 | B2 * | 1/2008 | Kim et al. | 399/110 |
| 7,334,786 | B2 * | 2/2008 | Shinga | 271/9.11 |
| 7,374,166 | B2 * | 5/2008 | Inoue | 271/264 |
| 7,380,780 | B2 * | 6/2008 | Sasaki et al. | 271/9.02 |

FOREIGN PATENT DOCUMENTS

| | | | |
|---|---|---|---|
| JP | 5-193766 | A | 8/1993 |
| JP | 6-298384 | A | 10/1994 |
| JP | 2002-274697 | A | 9/2002 |

* cited by examiner

*Primary Examiner*—Patrick H Mackey
*Assistant Examiner*—Prasad V Gokhale
(74) *Attorney, Agent, or Firm*—Birch, Stewart, Kolasch & Birch, LLP

(57) ABSTRACT

A paper feeder includes a paper storing section that stores papers by vertically stacking the papers on a loading plate, and the uppermost paper stored in the paper storing section is fed by a pickup roller. In order to transport a supplied paper to an image forming apparatus without changing its posture, paper outgoing apertures are individually disposed on the paper feeder side. Transfer paths, respectively corresponding to the paper outgoing aperture, are disposed in the image forming apparatus, and a paper supplied from the paper feeder is transported to an image formation processing section of the image forming apparatus. This allows a paper to be transported without being curved, when the paper is supplied to the image forming apparatus from an additionally provided paper feeder. As a result, paper jam is prevented.

8 Claims, 8 Drawing Sheets

PAPER FEEDER AND IMAGE FORMING APPARATUS

This Nonprovisional application claims priority under 35 U.S.C. § 119(a) on Patent Application No. 362097/2004 filed in Japan on Dec. 15, 2004, the entire contents of which are hereby incorporated by reference.

FIELD OF THE INVENTION

The present invention relates to a paper feeder including a plurality of paper storing sections that supply a paper to an image forming apparatus. The invention also relates to an image forming apparatus.

BACKGROUND OF THE INVENTION

In recent years, print processing speed of image forming apparatuses has become high-speed, and there has been growing demand for a large amount of printing. In order to satisfy the demand, high-capacity paper feeders have been developed as an optional device for a standard paper-feeding cassette (usually, the cassette can store approximately 500 sheets of paper) of an image forming apparatus. In many cases, a high-capacity paper feeder is adapted so that a large number of papers of one kind are stored, and that shortage of papers in the paper-feeding cassette is replenished. Further, there has also been proposed an arrangement in which several kinds of papers are respectively stored in separate paper storing sections which are disposed one above the other (see, for example, Japanese Unexamined Patent Publication No. 193766/1993 (Tokukaihei 5-193766, published on Aug. 3, 1993)).

FIG. 8 schematically illustrates a paper feeder installed in an image forming apparatus as disclosed in the above publications and elsewhere. In the figure, an image forming apparatus 700 includes an image forming section 701 adopting the electrophotographic process, a paper-supply section 702 that supplies a paper to the image forming section 701, and a fixing section 703. The fixing section 703 is disposed in a midway of a transport path through which a paper with an image formed by the image forming section 701 is ejected out of the image forming apparatus 1.

The paper-supply section 702 includes paper-feeding cassettes 702*a* and 702*b* that respectively store different sizes of papers and are disposed one above the other. A paper is supplied from a selected upper or lowest cassette to the image forming section 701. Then, the image forming section 701 forms an image onto the paper. In the case where double-sided image formation is performed, the paper, after transiting the fixing section 703, is looped back to the image forming section 701 through a sub paper-transport path 704, with the paper turned upside down.

Further, in addition to the paper-supply section 702 installed in the image forming apparatus 700, a manual paper-supplying path 705 is provided that is for supplying a paper of arbitrary size to the image forming section 701 upon necessity. A manual paper-supply section (not illustrated) is disposed on part of the manual paper-supplying path 705 from which a paper enters, so that a manually supplied paper is transported to the image forming section 701.

The image forming apparatus 700 structured as described above is provided with an external paper feeder 706 as an optional device, in addition to the paper-supply section 702 installed in the image forming apparatus 700. The external paper feeder 706 is installed on the image forming apparatus 700 in such a manner that it is in communication with the manual paper-supplying path 705 of the manual paper-supply section. The external paper feeder 706 includes, for example, vertically disposed three paper storing sections 706*a*, 706*b*, 706*c* that have a higher capacity than the paper-supply section 702 of the image forming apparatus 700. A paper at the top of the papers stored in the paper storing sections 706*a*, 706*b*, 706*c* is transported first. The transported paper is guided to the manual paper-supplying path 705 and is transported into the image forming apparatus 700 therefrom.

The paper feeder 706, as illustrated in FIG. 8, that is disclosed in the above publications is structured in such a way that several kinds of papers are stored in separate paper storing sections 706*a* to 706*c* that are vertically disposed. As such, the paper feeder 706 includes transport paths each formed for each type of papers to be stored. Further, the transport paths merge at one place, from which a paper is supplied to the image forming apparatus. In such structure of the paper feeder 706, a plurality of curves are formed in the transport paths in the paper feeder 706, and the curves exist in a limited space. This often causes jam or skewed transport of a paper while the paper is being transported in the paper feeder 706.

SUMMARY OF THE INVENTION

The present invention, therefore, has as an object to prevent, for example, jam or skewed transporting of a paper being transported. Another object is to solve a problem that an irregular size paper cannot be manually supplied when a high-capacity paper feeder is installed in an image forming apparatus.

In order to solve the problem, the present invention is structured as described below.

A paper feeder of the present invention that includes a plurality of paper storing sections supplying a paper to an image forming apparatus is characterized in that the paper feeder includes a plurality of paper outgoing apertures, respectively corresponding to the plurality of paper storing sections, for transporting a paper to the image forming apparatus.

The paper feeder is installed on a side of the image forming apparatus. Further, in the paper feeder, the plurality of paper storing sections may be vertically disposed.

At this time, in a case where only one paper outgoing aperture is provided for the plurality of paper storing sections, a paper transport path connecting the paper storing sections and that one paper outgoing aperture is forced to bend or curve. Therefore, a paper transported through the paper transport path is bent or curved, often causing jam or skewed transporting of papers in the paper transport path.

In contrast, a paper feeder of the present invention includes a plurality of paper outgoing apertures, respectively corresponding to a plurality of paper storing sections. This allows paper transport paths respectively connecting the paper storing sections and paper outgoing apertures to be formed without being bent or curved. Therefore, a paper can be transported through the paper transport paths without being bent or curved. As a result, paper jam or skewed transporting of papers can be prevented.

BRIEF DESCRIPTION OF THE DRAWINGS

FIG. 3(*b*) is an explanatory diagram illustrating respective positions of the junction claws in supplying a paper from a paper feeder.

FIG. 3(*c*) is an explanatory diagram illustrating respective positions of the junction claws in supplying a paper through a manual paper-supply transport path.

DESCRIPTION OF THE EMBODIMENTS

First Embodiment

Figure 1:
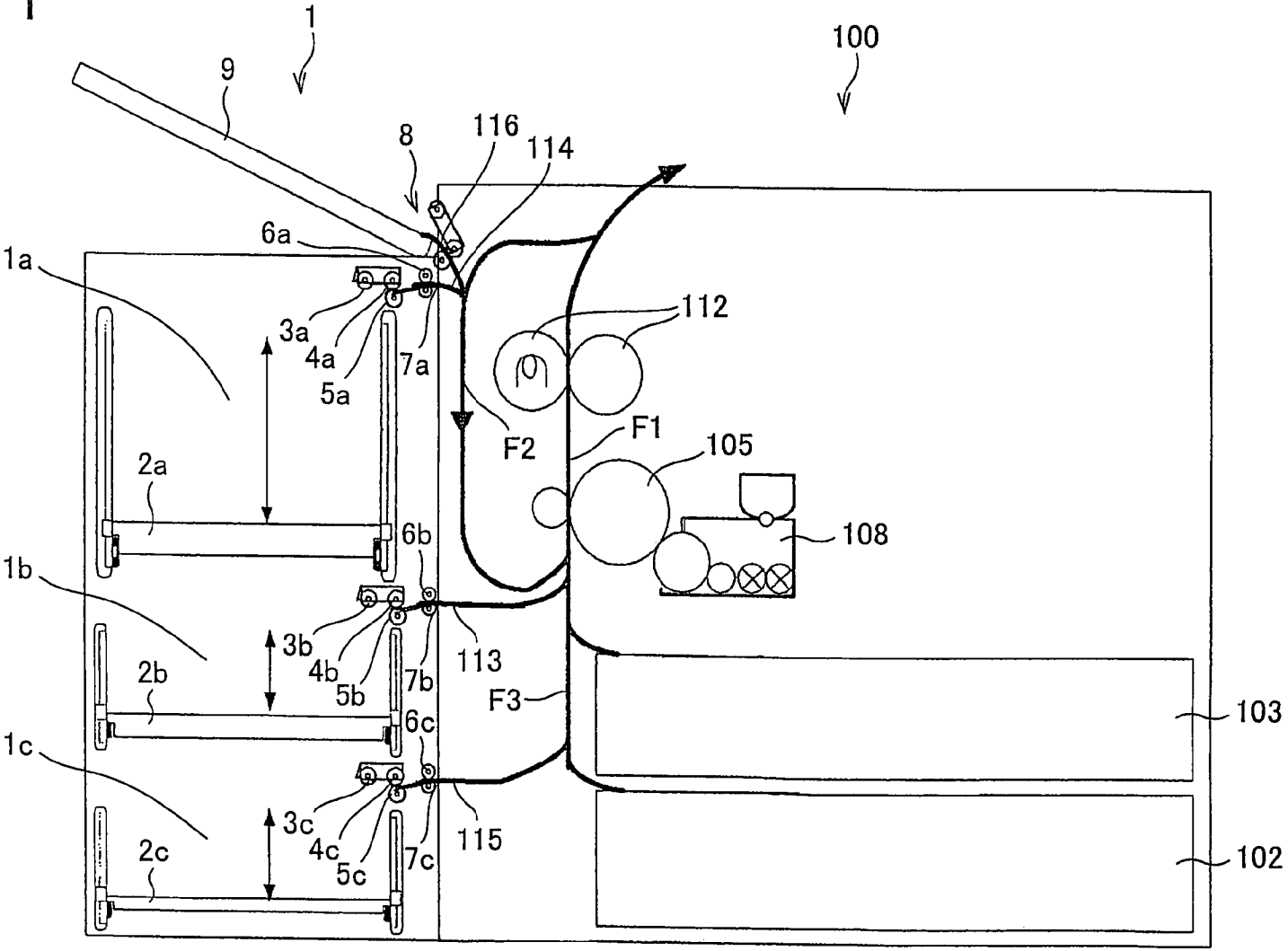
FIG. 1 is a front view that schematically illustrates a structure of a paper feeder according to the present invention, and a structure of an image forming apparatus including the paper feeder.
Figure 2:
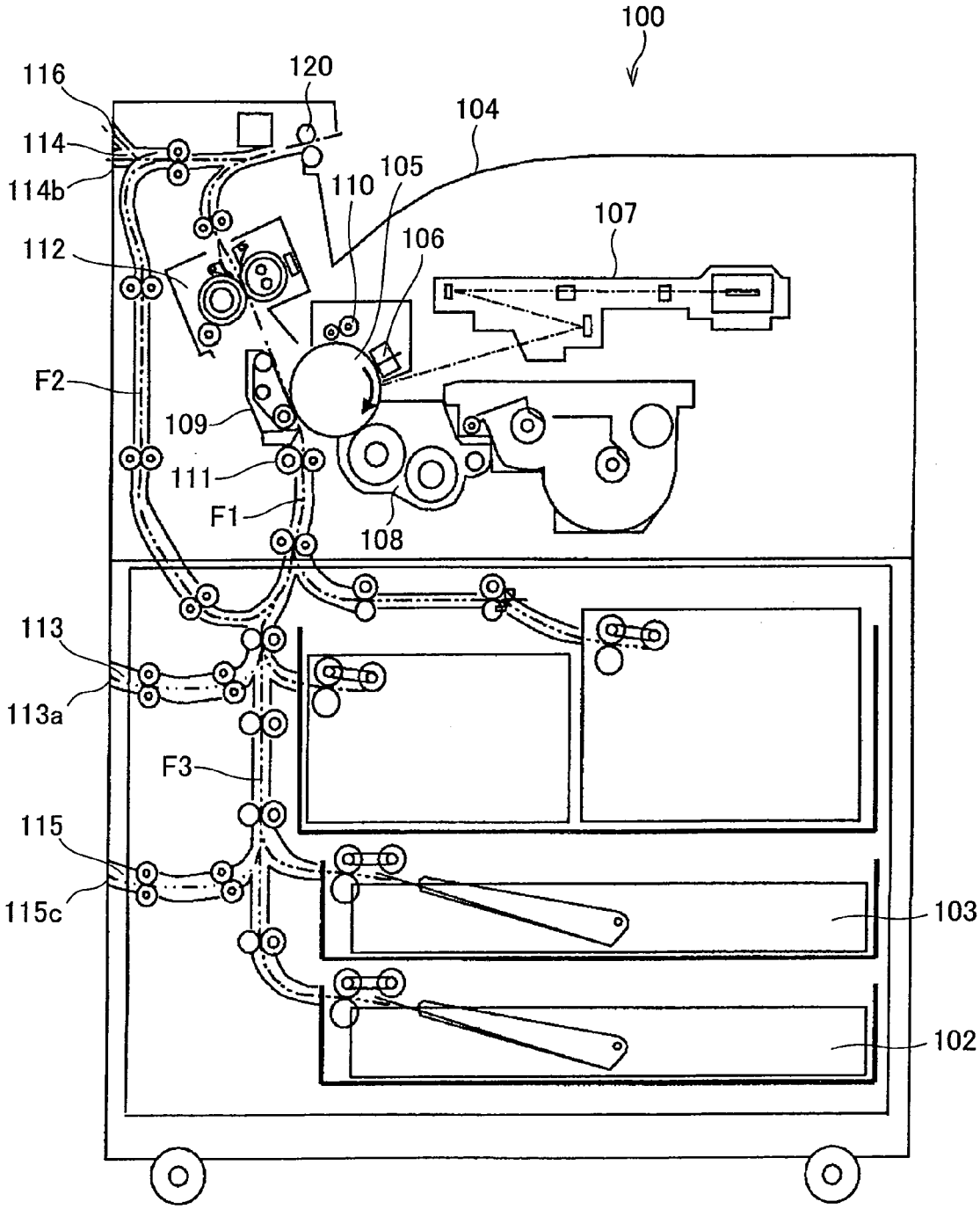
FIG. 2 is a longitudinal sectional view that schematically illustrates a structure of the image forming apparatus illustrated in FIG. 1.

The following describes an embodiment of the present invention, with reference to figures. FIG. 1 is a front view that schematically illustrates a structure of a paper feeder according to the present invention and a structure of an image forming apparatus including the paper feeder. FIG. 2 is a longitudinal sectional view that schematically illustrates a structure of the image forming apparatus.

Initially, the following describes the image forming apparatus, with reference to FIG. 2. An image forming apparatus 100 forms an image onto a paper, using an image formation processing section 117 of an electrophotographic system. The image forming apparatus 100 includes paper-feeding cassettes 102 and 103 disposed one above the other at a bottom portion, and an ejected paper tray 104 at a top portion. A paper transport path F1 is disposed in between the paper-feeding cassettes 102 and 103, and the ejected paper tray 104.

On the paper transport path F1 is disposed a photosensitive drum 105 that is driven to rotate in the direction indicated by the arrow. The photosensitive drum 105 constitutes the image forming processing section 117. In the neighborhood of the photosensitive drum 105, an electrical charging device 106, a light scanning unit 107, a developing unit 108, a transfer device 109, a cleaning unit 110, and a charge removing device (not illustrated) are positioned in the direction of rotation.

On the upstream of the photosensitive drum 105 in the transport direction of papers, there is disposed a registration roller 111 that adjusts a timing of supplying a paper to a transfer position in between the photosensitive drum 105 and the transfer device 109. On the other hand, on the downstream of the photosensitive drum 105, there is disposed a fixing device 112.

The electrical charging device 106 charges a surface of the photosensitive drum 105 at a predetermined electric potential. The light scanning unit 107, based upon image data inputted from an external device, emits a laser beam onto the surface of the photosensitive drum 105. This allows an electrostatic latent image, corresponding to the image data, to be formed on the surface of the photosensitive drum 105. The developing unit 108 supplies the surface of the photosensitive drum 105 with toner, and converts the electrostatic latent image to a visible image (toner image) with the toner. The toner image formed on the photosensitive drum 105 is transferred onto a paper by the transfer device 109 and is fixed to the paper by the fixing device 112. The paper to which the toner image is fixed is ejected through an ejection roller 120 to the ejected paper tray 104.

After the toner image is transferred onto the paper, residual toner on the surface of the photosensitive drum 105 is removed and collected by the cleaning unit 110. Further, electric charge on the surface of the photosensitive drum 105 is removed by the charge removing device to prepare for next image formation.

The image forming apparatus 100 further includes a reversed-paper transport path F2. In forming an image on a side of a paper having been formed with an image on the other side, the reversed-paper transport path F2 reverses sides of the paper and transports the paper to a transfer position.

The reversed-paper transport path F2 is a transport path formed for reversing sides of a paper. One end (upstream end) of the reversed-paper transport path F2 is connected to a part of the paper transport path F1 in the vicinity of a downstream end, and the other end (downstream end) of the reversed-paper transport path F2 is connected to a part of the paper transport path F1 upstream of the registration roller 111.

In the above structure, in a case where sides of a paper are reversed, the paper onto which an image has been formed is detected by a detection sensor before the paper reaches the ejection roller 120 and immediately before the paper is ejected to the ejected paper tray 104. In response, the rotation of the ejection roller 120 is reversed, so that the paper is looped back to the reversed-paper transport path F2. After being transported through the reversed-paper transport path F2, the paper is transported to the paper transport path F1 that goes through the image formation processing section 117. Then, by traveling through the paper transport path F1, the paper is transported to the image formation processing section 117 via the registration roller 111.

Meanwhile, a paper-feeding roller is provided for each of the paper-feeding cassettes 102 and 103 positioned one above the other. The paper-feeding roller is disposed in such a way as to counter the corresponding paper-feeding cassette. A paper at the top is selected and transported first. A paper supplied from the paper-feeding cassettes 102 and 103 is first transported to a supplied-paper transport path F3 that is connected to the paper transport path F1. Then, the paper is transported to the paper transport path F1.

FIG. 2 illustrates a structure in which another paper-supply section is included in between the image formation processing section 117 and the upper paper-feeding cassette 103, and in which a paper is also supplied from the paper-supply section to the paper transport path F1. The paper-supply section is disposed upon necessity and does not directly relate to the present invention. Thus explanation thereof is omitted.

As described above, in the image forming apparatus 100 is disposed a main paper-supply section including, for example, paper-feeding cassettes 102 and 103. Further, a supplied-paper transport path F3 and the paper transport path F1 are disposed so that a paper supplied from the paper-supply section is ejected to the ejected paper tray 104 through the image formation processing section 117. Further, in addition to these transport paths, the reversed-paper transport path F2 is disposed such that a paper being ejected is looped back to the paper transport path F1 for double-sided image formation.

The paper-feeding cassettes 102 and 103 are used for continuously supplying papers of the same size. There are cases, however, in which printing of one sheet or a small number of sheets having a different paper size from that of the papers stored in the cassettes is desired. In such a case, a manual paper-supply section (not illustrated) is disposed to transport a paper to the paper transport path F1. The manual paper-supply section includes, for example, a manual paper-supply tray for loading a paper of arbitrary size, and a paper-feeding roller for supplying one of the papers piled on the manual paper-supply tray. The manual paper-supply section, in FIG. 2, is disposed to correspond to the manual paper-supply transport path 113 that is connected to the paper transport path F1.

Further, apart from the manual paper-supply transport path 113, in the image forming apparatus 100, transport paths 114 and 115 are provided. The transport paths 114 and 115 are for transporting a paper, supplied from an optionally provided high-capacity paper feeder 1 (illustrated in FIG. 1), to the registration roller 111. The transport path 114 is disposed in such a way as to be connected to a part of the reversed-paper transport path F2 that is for forming (printing) an image on both sides of a paper. For example, the transport path 114 is disposed at a place that corresponds to an upper part (close to the upstream end) of the reversed-paper transport path F2. Further, a transport path (incoming paper transport path) 115 is a transport path disposed in such a way as to be connected to the supplied-paper transport path F3 that transports a paper supplied from the paper-feeding cassette 102.

In the image forming apparatus 100, inlet openings 113*a*, 114*b*, 115*c* are formed, respectively corresponding to inlet ends of the manual paper-supply transport path 113 and the transport paths 114 and 115. The inlet openings 113*a*, 114*b*, 115*c* are disposed on one side of the image forming apparatus 100 on which the paper feeder 1 is disposed. The inlet openings 113*a*, 114*b*, 115*c* are for accepting a paper.

Onto the image forming apparatus 100 structured as described above, the paper feeder 1 illustrated in FIG. 1 of the embodiment is installed as an optional device. In FIG. 1, the image forming apparatus 100 described with reference to FIG. 2 is illustrated with particular emphasis on the transport paths for transporting a paper, and as such the paper transporting rollers for transporting a paper are omitted in FIG. 1.

The paper feeder 1 is installed to assist paper feeding carried out by the internal paper feeder that is disposed in the image forming apparatus 100 and includes paper-feeding cassettes 102 and 103. The paper feeder 1, further more, is installed to accommodate high-capacity image formation processing. For example, in order to satisfy a demand for selecting and supplying a paper of different size from that of a paper stored in the paper-feeding cassettes 102 and 103 in the image forming apparatus 100, or for carrying out a large volume of printing (image formation), the paper feeder 1 is used to store and feed a large number of papers having the same size as that of papers stored in, for example, the internally disposed paper-feeding cassette 102. Further, if the paper-feeding cassettes 102 and 103 in the image forming apparatus 100 can sufficiently supply papers, in place of the paper feeder 1, a manual paper-supply section to be described below is installed at a position corresponding to that of the manual paper-supply transport path 113.

Accordingly, the paper feeder 1 of the embodiment is installed on a side of the image forming apparatus 100, i.e., the side on which the manual paper-supply section is disposed, for example. The paper feeder 1 includes, for example, three paper storing sections 1*a*, 1*b*, 1*c* vertically. The paper feeder 1 further includes loading plates 2*a*, 2*b*, 2*c*, a lifting-up mechanism (not illustrated), picking-up rollers 3*a*, 3*b*, 3*c*, feeding rollers 4*a*, 4*b*, 4*c*, reversing rollers 5*a*, 5*b*, 5*c*, paper transporting rollers 6*a*, 6*b*, 6*c*, and paper outgoing apertures 7*a*, 7*b*, 7*c*, respectively corresponding to the paper storing sections 1*a*, 1*b*, 1*c*.

Papers are stored by being positioned and piled on the loading plates 2*a*, 2*b*, 2*c*. The lifting-up machine moves up or down the loading plates 2*a*, 2*b*, 2*c*, so that the surface of a paper at the top of a pile of paper loaded on the loading plates 2*a*, 2*b*, 2*c* is positioned at a predetermined level.

The picking-up rollers 3*a*, 3*b*, 3*c* are structured so as to be moved up or down. When feeding a paper, the picking-up rollers 3*a*, 3*b*, 3*c* descend and supply the upper most paper in the pile of papers loaded on the loading plates 2*a*, 2*b*, 2*c*. The feeding rollers 4*a*, 4*b*, 4*c* and the reversing rollers 5*a*, 5*b*, 5*c* are oppositely disposed downstream of the picking-up rollers 3*a*, 3*b*, 3*c* in a direction of paper-transfer. The feeding rollers 4*a*, 4*b*, 4*c* are rotated in the same direction as the rotation of the picking-up rollers 3*a*, 3*b*, 3*c*. The reversing rollers 5*a*, 5*b*, 5*c* are rotated in the same direction as the rotation of the feeding rollers 4*a*, 4*b*, 4*c* and in the opposite direction of paper-transfer.

Papers picked by the picking-up rollers 3*a*, 3*b*, 3*c* are sorted by the feeding rollers 4*a*, 4*b*, 4*c* and the reversing rollers 5*a*, 5*b*, 5*c*. Then, the papers are supplied to the transport path one by one.

The paper transporting rollers 6*a*, 6*b*, 6*c* are disposed downstream of the feeding rollers 4*a*, 4*b*, 4*c* and the reversing rollers 5*a*, 5*b*, 5*c* in a direction of paper-transfer. On a downstream side of the paper transporting rollers 6*a*, 6*b*, 6*c* in the transport path, there are provided paper outgoing apertures 7*a*, 7*b*, 7*c* that eject a paper out of the paper feeder 1. A paper picked up by the picking-up rollers 3*a*, 3*b*, 3*c* and processed by the feeding rollers 4*a*, 4*b*, 4*c* and the reversing rollers 5*a*, 5*b*, 5*c* is transported by the paper transporting rollers 6*a*, 6*b*, 6*c* and is ejected out of the paper feeder 1 by the paper outgoing apertures 7*a*, 7*b*, 7*c*.

A paper feeder 1 of the embodiment that is structured as described above is installed in such a way that the paper outgoing aperture 7*b* corresponding to the paper storing section 1*b*, which is a middle tray, corresponds to the inlet opening 113*a* of the manual paper-supply transport path 113 in the manual paper-supply section of the image forming apparatus 100. Further, the paper outgoing aperture 7*a* corresponding to the upper paper storing section 1*a* of the paper feeder 1 is disposed in such a way as to correspond to the inlet opening 114*b* of the transport path 114 connected to the reversed-paper transport path F2 in the image forming apparatus 100. Further, the paper outgoing aperture 7*c* corresponding to the lowest paper storing section 1*c* is disposed in such a way as to correspond to the inlet opening 115*c* of the transport path 115 connected to the supplied-paper transport path F3 in the image forming apparatus 100.

In the structure described above, a paper stored in the paper storing sections 1*a*, 1*b*, 1*c* of the paper feeder 1, when selected and supplied, is transported to the image forming apparatus 100. In this case, there is no portion that is bent or widely curved in the transport path through which the paper is transported from the paper feeder 1 to the image forming apparatus 100. Therefore, the paper supplied from the paper storing sections 1*a*, 1*b*, 1*c* is transported to the transport paths 113, 114, 115 of the image forming apparatus 100 without being bent during the transfer.

In the conventional structure described above in the "BACKGROUND OF THE INVENTION", there is only one paper outgoing aperture for transporting a paper from the paper feeder 1 to the image forming apparatus 100. Therefore, in the paper feeder 1, some of the transport paths for transporting a paper are bent.

On the other hand, in the paper feeder 1 of the embodiment, paper outgoing apertures 7*a*, 7*b*, 7*c* are disposed so as to respectively correspond to papers supplied from the paper storing sections 1*a*, 1*b*, 1*c*. In accordance with the structure, inlet openings corresponding to the paper outgoing apertures 1*a*, 1*b*, 1*c* are disposed on the image forming apparatus 100. The inlet openings are in communication with the transport paths through which a paper supplied from the inlet openings is transported to the image formation processing section 117.

Therefore, in the paper feeder 1 of the present invention, when a paper is supplied to the image forming apparatus 100, bending of the paper on the way to the image forming apparatus 100 can be minimized, thereby preventing paper jam or skewed transport of papers.

In other words, a paper to be supplied from the paper feeder 1 to the image forming apparatus 100 is transported through a substantially straight transport path. This can prevent paper jam in the paper feeder 1. Further, the paper outgoing apertures 7*a*, 7*b*, 7*c* are disposed so that the transport path in the paper feeder 1 can be formed in a straight shape without being widely curved. This provides the additional effects of simplifying the design and assembly of the paper feeder 1, among other things.

Further, because the transport path 114 that accepts a paper from the paper feeder 1 is disposed on the reversed-paper transport path F2 in the image forming apparatus 100, no additional transport path for transporting the paper to the image formation processing section 117 needs to be formed. Further, in this structure, a paper supplied from the paper feeder 1 is conveyed to the supplied-paper transport path F3 that guides the paper supplied from the paper-feeding cassette 102, which is an internal paper-supply section in the image forming apparatus 100. Therefore, no transport path other than the short transport path 115 needs to be provided in the image forming apparatus 100, thereby avoiding an increase in size of the image forming apparatus 100.

In the paper feeder 1 of the embodiment illustrated in FIG. 1, the upper paper storing section 1*a* has the highest storing capacity, but the lowest paper storing section 1*c* may be set to have the highest storing capacity so as to make the paper feeder 1 more stable. This can, for example, prevent the paper feeder 1 from falling. Further, in order to prevent the paper feeder 1 from falling, the lowest paper storing section 1*c* may store largest size papers. This, too, improves stability of the device. An important thing is to make the lowest paper storing section 1*c* heavier than the upper paper storing section 1*a*.

Further, from another point of view, with regard to image forming speed of the image forming apparatus 100, printing speed can be improved by storing most-frequently-used papers in a paper storing section that has the shortest paper transport path, for example the paper storing section 1*b*.

Further, the paper storing section may store not only papers but also other types of sheets such as OHP films.

The above description presented a structure in which three types of paper storing sections were provided in the paper feeder 1 of the embodiment, but more than three paper storing sections may be provided therein. Further, it is apparent that the paper feeder 1 may be structured to include at least two vertically-disposed paper storing sections. For example, the paper storing section 1*c* may be included in the paper storing section 1*b*, and a paper may be supplied from the paper storing section 1*b* to the manual paper-supply transport path 113. Further, the paper feeder 1 may be structured with the upper paper storing section 1*a* being omitted. The paper feeder 1 without the upper paper storing section 1*a* provides equivalent effect to that of the paper feeder 1 including three types of paper storing sections.

Second Embodiment

The First Embodiment described a structure in which a paper feeder 1 is installed onto an image forming apparatus 100 and no manual paper-supply section is mounted. There may be a case, however, that a manual paper-supply section is demanded to print on one or a few papers even when the paper feeder is installed onto the image forming apparatus 100. In order to respond to such a demand, in the embodiment, a manual paper-supply section 8 is provided at the top, as illustrated in FIG. 1. The manual paper-supply section 8 is a conventionally known structure, and therefore the structure will be briefly described below.

The paper-supply section 8 includes a manual paper-supply tray 9 for a paper to be placed, and as described above, further includes a picking-up roller, a feeding roller, and a reversing roller to transfer the uppermost paper of the placed papers. The picking-up roller, the feeding roller, and the reversing roller are disposed on, for example, the paper feeder side. In the image forming apparatus 100, an inlet opening is formed to correspond to the manual paper-supply tray 9. The inlet opening is in communication with the transport path 116 that joins the reversed-paper transport path F2, as illustrated in FIG. 2. The transport path 116 is disposed at the substantially same position as the transport path 114 that corresponds to the upper paper storing section 1*a* in the paper feeder 1.

This structure allows the paper-supply section 8 to be mounted. A paper supplied from the manual paper-supply section 8 is transported to the reversed-paper transport path F2 and then transported to the image formation processing section through the paper transport path F1. This allows an image to be formed on a different paper from papers stored in, for example, the paper feeder 1 or on a paper of arbitrary size.

In this case, it is necessary for a paper to be accurately guided to an appropriate transport path, depending upon whether the paper is supplied from the manual paper-supply section 8, the paper is supplied from the upper paper storing section 1*a*, or the paper is looped back for double-sided image formation. If the paper is not accurately guided to an appropriate transport path, paper jam may occur or the paper may be transported to an inappropriate position.

To resolve such problems, a structure is required in which a paper is accurately guided at a junction to the reversed-paper transport path F2. The following describes a structure therefore, with reference to FIG. 3.

Figure 3:
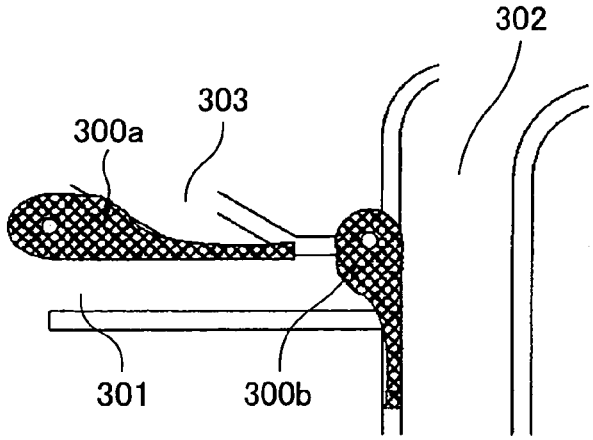
FIG. 3(*a*) is an explanatory diagram of junction claws at two locations that are included in the image forming apparatus illustrated in FIG. 1, showing respective positions of the junction claws during double-sided printing.
Figure 3:
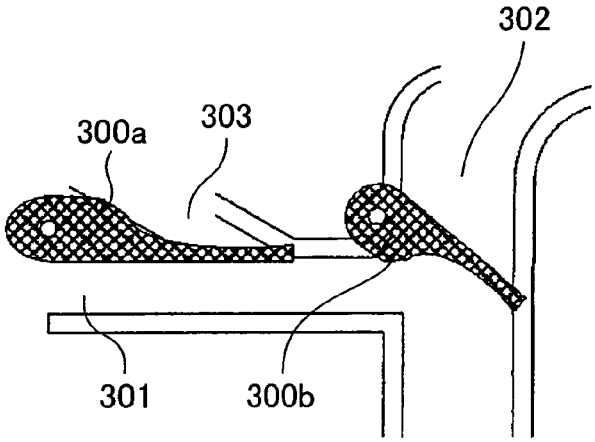
Figure 3:
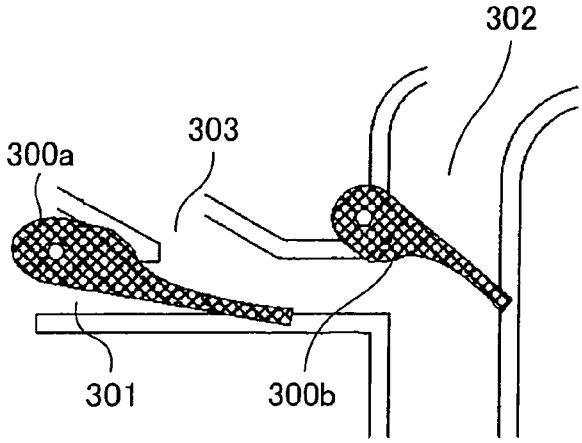

In FIG. 3, the reversed-paper transport path F2 provided in the image forming apparatus 100 is indicated with reference numeral 302. A first transport path 301 merges into the reversed-paper transport path 302. The first transport path 301 was described above as the transport path 114 that transports a paper supplied from the upper paper storing section 1*a* in the paper feeder 1. Further, a paper supplied from the manual paper-supply section 8 described above is transported to the reversed-paper transport path 302 through a second transport path 303. The second transport path 303 is the same as the transport path 116 illustrated in FIG. 2. In this example, a paper supplied to the second transport path 303 is guided to the reversed-paper transport path 302 through the first transport path 301.

At the junction where the first transport path 301 merges into the reversed-paper transport path 302, a junction claw 300*b* is rotatably provided. Further, at the junction where the second transport path 303 merges into the first transport path

301, a junction claw 300*a* is rotatably provided. A portion of junction claws 300*a* and 300*b* with which a paper transported through the first transport path 301 or the second transport path 303 comes into contact are curved to have a concavity shape.

Figure 4:
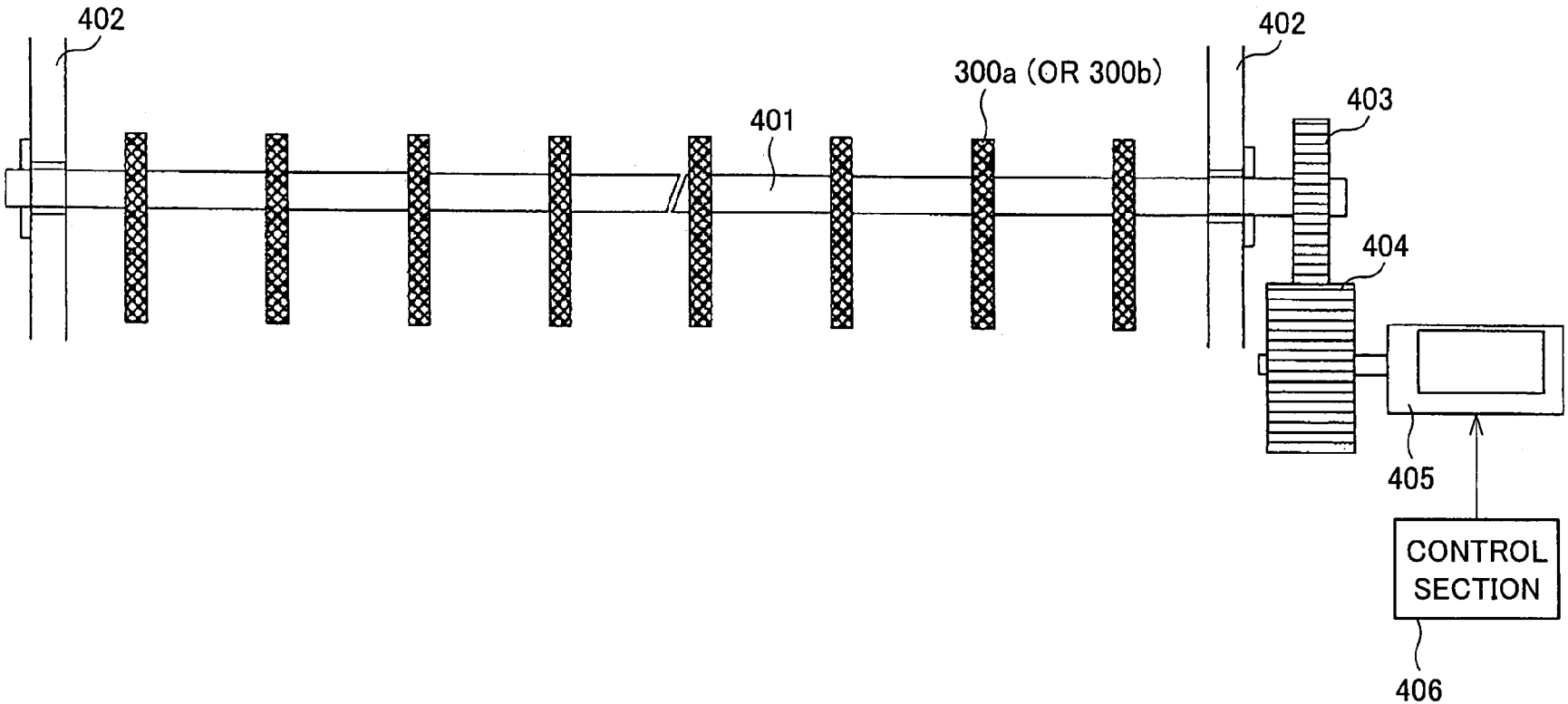
FIG. 4 is an explanatory diagram illustrating a structure in which a junction claw included in the image forming apparatus illustrated in FIG. 1 is switched by a driving source.

Switching of the junction claws 300*a* and 300*b* are controlled with the control section 406. As illustrated in FIG. 4, a plurality of junction claws are disposed at certain intervals between each other on a shaft 401 that is driven to rotate. A gear 403 fixed to the shaft 401 is in mesh with a gear 404 fixed to an axle of a driving source (motor) 405. This causes the shaft 401 to rotate and thereby controls switching of the plurality of junction claws 300*a* or the plurality of junction claws 300*b*. Specifically, switching of the junction claws 300*a* or 300*b* is controlled by controlling driving of the motor (switching driving section) 405.

FIG. 3(*a*) illustrates locations of the junction claws 300*a* and 300*b* when the reversed-paper transport path 302 is used for performing double-sided printing (position X). This is a home position of the junction claws 300*a* and 300*b*. In this position, the first transport path 301 is closed by the junction claw 300*b*, thereby allowing a paper to be transported through the reversed-paper transport path 302.

FIG. 3(*b*) illustrates locations of the junction claws 300*a* and 300*b* when the transport path 301 is used to transfer a paper supplied from the paper feeder 1 (position Y). In this position, the second transport path 303 is closed by the junction claw 300*a*. In addition, the junction claw 300*b* is switched to close an upstream part of the reversed-paper transport path 302. This connects the first transport path 301 and the reversed-paper transport path 302, thereby allowing a paper to be transported through the instantly formed path.

FIG. 3(*c*) illustrates locations of the junction claws 300*a* and 300*b* when the manual paper-supply transport path 303 is used (position Z). In this position, the junction claw 300*a* is switched to open the first transport path 303 and close the first transport path 301, and the junction claw 300*b* is switched to close an upstream part of the reversed-paper transport path 302. This connects the second transport path 303 and the reversed-paper transport path 302, thereby allowing a paper to be transported through the instantly formed path.

FIG. 4, described above but described again here, is a diagram schematically illustrating junction claws switched with the driving source (for example, a motor). The shaft 401 is freely and rotatably supported by the device casing 402, with one end fixed to the gear 403. The gear 403 of the shaft 401 is in mesh with the driving gear 404 connected to the driving source (motor) 405, and the shaft 401 is rotated upon rotation of the driving source 405. Therefore, the junction claws 300*a* or 300*b* fixed to the shaft 401 are switched in accordance with the rotation of the shaft 401 caused by the driving source 405. Further, operation of the driving source 405 is controlled by the control section 406.

As described above, the junction claws 300*a* and 300*b* are controlled to be switched to position X in double-sided printing, to position Y when a paper is supplied from the upper paper storing section 1*a* in the paper feeder 1, and to position Z when a paper is supplied from the manual paper-supply section. This allows a transport path suitable for each transporting of papers to be formed, thereby preventing paper jam or skewed transporting of papers.

Figure 6:
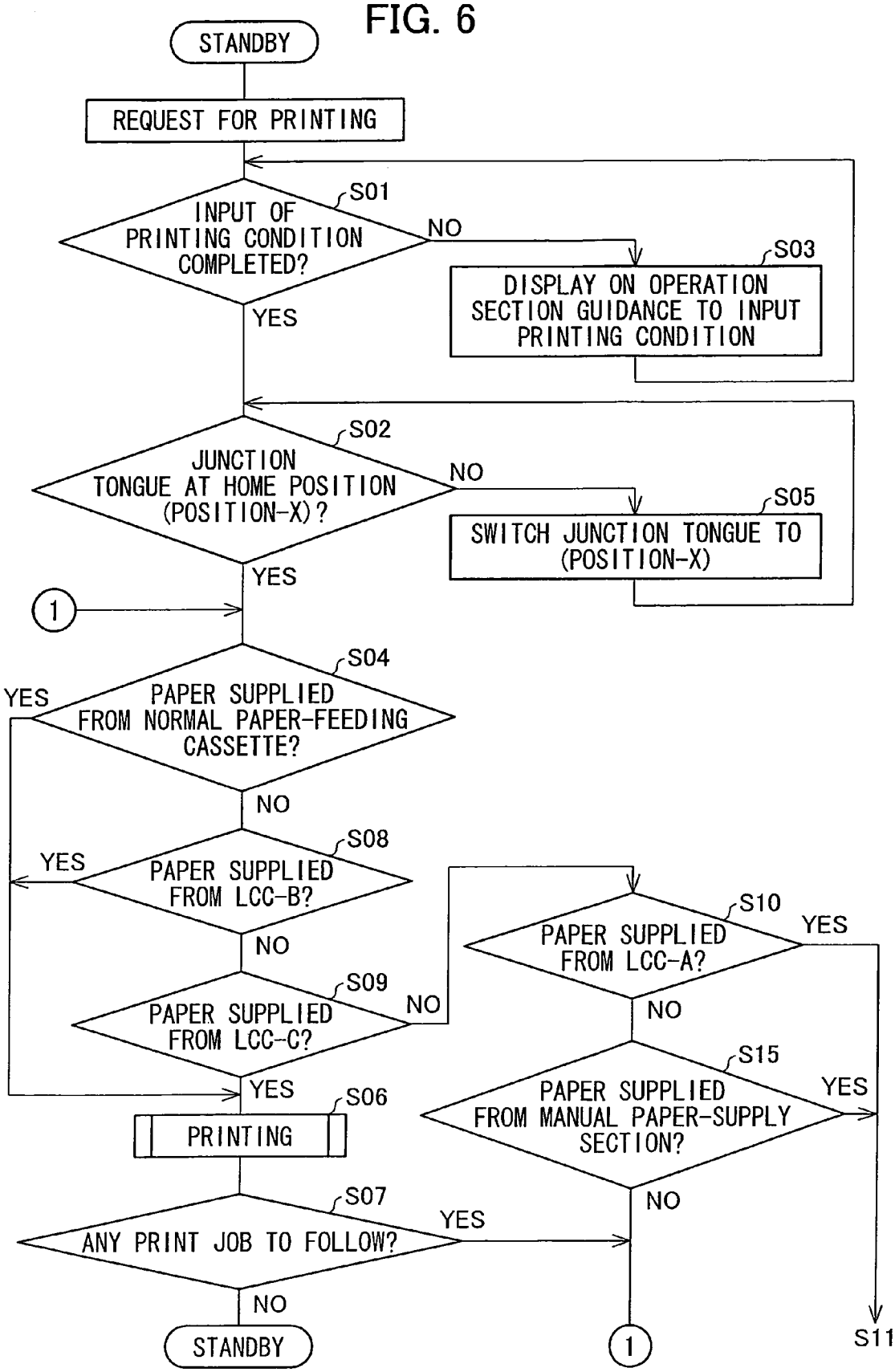
FIG. 6 is a flow chart illustrating a switching control operation of a junction claw included in the image forming apparatus illustrated in FIG. 1.
Figure 7:
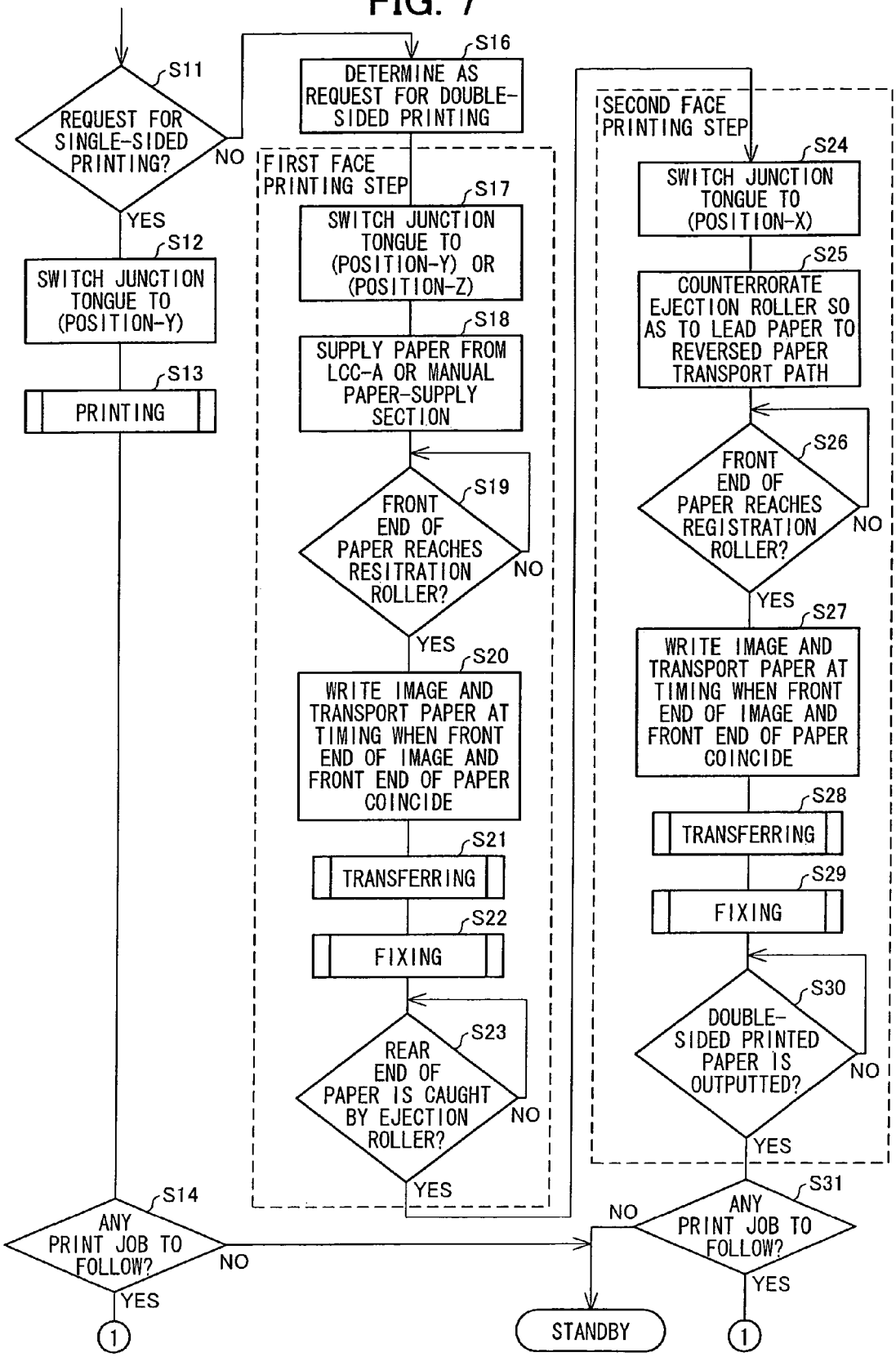
FIG. 7 is a flow chart continuing from FIG. 6.
Figure 8:
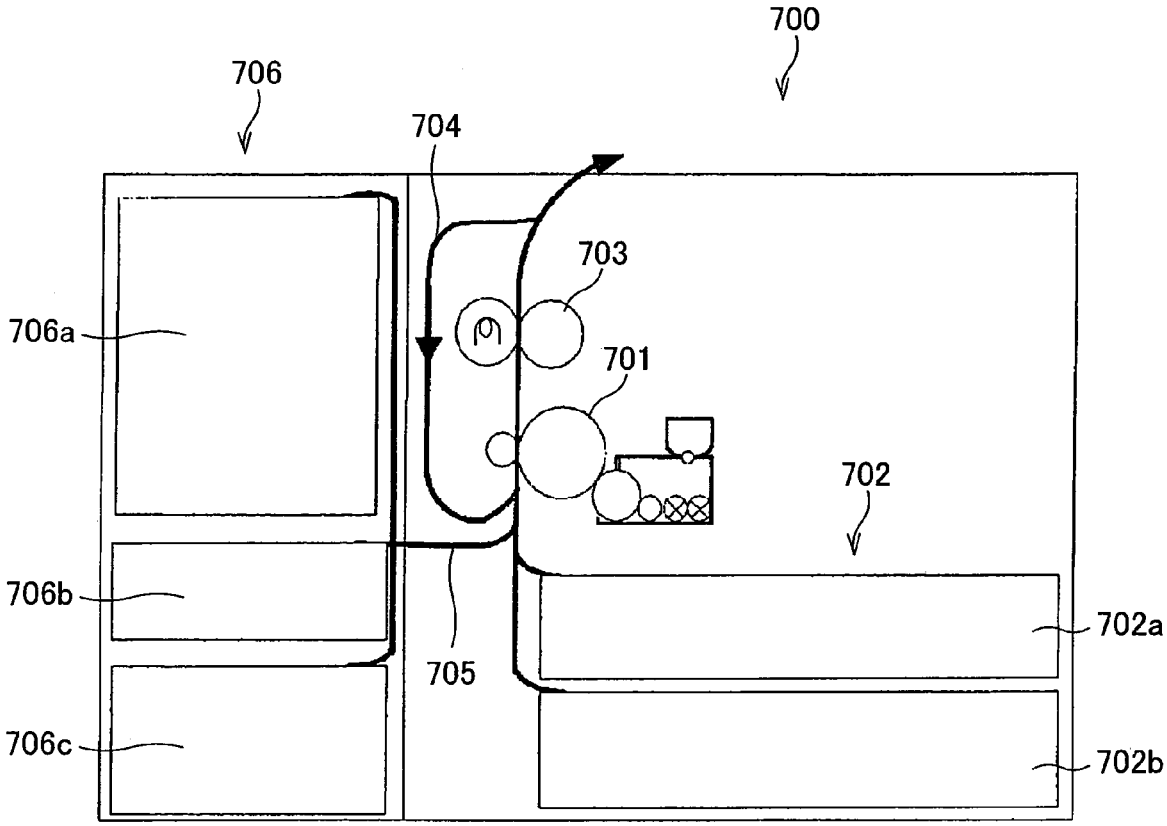
FIG. 8 is a front view that schematically illustrates an image forming apparatus including a conventional external paper feeder.

The following describes a control operation concerning paper transport in the above structure, with reference to flow charts in FIG. 6 and FIG. 7.

First of all, when printing is requested in the standby state, it is determined in step S01 whether input of print conditions has been completed. If the input has been completed, the sequence goes to S02. In S02, it is determined whether the junction claws 300*a* and 300*b* are at the home position (position X).

If it is determined in S01 that the input of print conditions has not been completed, the sequence goes to S03. In S03, a reminder of entry of print conditions is displayed on an operation section, and printing is requested. If it is determined in S02 that the junction claws are at the home position (position X), the sequence goes to S04. In S04, it is determined whether a paper to be printed is a paper supplied from a normal paper-feeding cassette. The normal paper-feeding cassette here indicates the paper-feeding cassette 102 or 103 that is normally disposed in the image forming apparatus 100.

If it is determined in S02 that the junction claws 300*a* and 300*b* are not at the home position (position X), the sequence goes to S05. In S05, the junction claws 300*a* and 300*b* are controlled to be switched to the home position (position X). In order to do so, the driving source 405 is driven, and the junction claws are switched to the position illustrated in FIG. 3(*a*).

If it is determined in S04 that the paper is supplied from the normal paper-feeding cassette, the sequence goes to S06 and printing is carried out. Then, in S07, it is determined whether there is a print job to follow. If it is determined that there is a print job to follow, the sequence goes back to S04. If not, the sequence goes to the standby state.

If it is determined in S04 that the paper is not supplied from the normal paper-feeding cassette, the sequence goes to S08. In S08, it is determined whether the paper is supplied from the paper storing section 1*b* (LCC-B). If it is determined in S08 that the paper is supplied from the paper storing section 1*b* (LCC-B), the sequence goes to S06 and the same process as described above is carried out.

On the other hand, if it is determined in S04 that the paper is not supplied from the paper storing section 1*b* (LCC-B), the sequence goes to S09. In S09, it is determined whether the paper is supplied from the paper storing section 1*c* (LCC-C). If it is determined in S09 that the paper is supplied from the paper storing section 1*c* (LCC-C), the sequence goes to S06 and the same process as described above is carried out.

If it is determined in S09 that the paper is not supplied from the paper storing section 1*c* (LCC-C), the sequence goes to S10. In S10, it is determined whether the paper is supplied from the paper storing section 1*a* (LCC-A). If it is determined in S10 that the paper is supplied from the paper storing section 1*a* (LCC-A), the sequence goes to S11 (see FIG. 7). In S11, it is determined whether the request is for single-sided printing. If it is determined in S11 that the request is for single-sided printing, the sequence goes to S12. In S12, the junction claws 300*a* and 300*b* are switched to position Y (the position illustrated in FIG. 3(*b*)).

After the junction claws 300*a* and 300*b* are switched to position Y, printing is carried out (S13). Then, it is determined whether there is a printing job to follow (S14). If it is determined that there is a printing job to follow, the sequence goes back to S04. This is performed repeatedly. If it is determined that there is no printing job to follow, the sequence goes to the standby state.

Further, if it is determined in S11 that the request is not for single-sided printing, the sequence goes to S16. In S16, it is determined that the request is for double-sided printing, and the sequence goes to S17. In S17, the junction claws 300*a* and 300*b* are switched to position Y, and the sequence goes to S18. In S18, a paper is supplied from the paper storing section 1*a* (LCC-A) or the manual paper-supply section. Then, in S19, it is determined whether a front end of the paper has reached the registration roller 111. If it is determined in S19 that the front end of the paper has reached the registration roller 111, the sequence goes to S20. In S20, an image is transferred onto the paper at a timing when the front end of the image coincides with the front end of the paper, and the paper is conveyed. Subsequently, a transfer process is carried out, and then a fixing process is carried out (S21, S22).

Then, in S23, it is determined whether a rear end of the paper is caught by the ejection roller 120. The steps of S17 to S23 constitute a first face printing step. If it is determined in S23 that the rear end of the paper is caught by the ejection roller 120, the sequence goes to S24. In S24, the junction claws 300*a* and 300*b* are switched to position X, and the sequence goes to S25. In S25, rollers are rotated in the reverse direction so as to guide the paper to the reversed-paper transport path 302.

After the above processes, it is determined whether the front end of the paper has reached the registration roller 111 (S26). If it is determined in S26 that the front end of the paper has reached the registration roller 111, the sequence goes to S27. In S27, an image is transferred onto the paper at a timing when the front end of the image coincides with the front end of the paper, and the paper is conveyed. Subsequently, a transfer process is carried out in S28, and then a fixing process is carried out in S29. Next, in S30, it is determined whether the paper with both sides printed has been conveyed to the outside. The steps of S24 to S30 constitute a second face printing step. If it is determined in S30 that the paper has been conveyed to the outside, the sequence goes to S31. In S31, it is determined whether there is a printing job to follow. If it is determined that there is a printing job to follow, the sequence goes back to S04. If not, the sequence goes to the standby state.

If it is determined in S10 (see FIG. 6) that the paper is not supplied from the paper storing section 1*a* (LCC-A), the sequence goes to S15. In S15, it is determined whether the paper is supplied from the manual paper-supply section. If it is determined that the paper is supplied from the manual paper-supply section, the sequence goes to S11. If the request is for double-sided printing, the same processes as described above are carried out. At this point, if the request is for double-sided printing and the paper is supplied from the manual paper-supply section, in S17, the junction claws 300*a* and 300*b* are controlled to be switched to position Z. The rest is the same as the control (S18 to S31) described above, and therefore description thereof is omitted. If it is determined in S15 that the paper is not supplied from the manual paper-supply section, the sequence goes back to S04.

As described above, switching of the junction claws 300*a* and 300*b* are controlled so that the paper is reliably guided to a predetermined transport path, not to a wrong transport path, thereby preventing, for example, paper jam.

Further, the embodiment described a structure in which the motor constituting the driving source 405 for switching the junction claws 300*a* and 300*b* is driven to rotate, and in which the driving source 405 is controlled by the control section 406 (for example, microcomputer). The driving source can be substituted by, for example, a solenoid. For example, in FIG. 3(*a*), a spring is connected to the shaft 401 illustrated in FIG. 4 in such a way that the junction claws 300*a* and 300*b* are spring-loaded to the home position. This allows the junction claws 300*a* and 300*b* to be positioned at the home position by a positioning section (not illustrated). The solenoid for rotating against the force of the spring is connected. By activating the solenoid (passing a current therethrough), the shaft 401 is rotated so that the junction claws 300*a* and 300*b* are switched. By deactivating the solenoid (stopping a current), the junction claws 300*a* and 300*b* can return to the original position by the force of the spring.

With this structure, switching of the junction claws 300*a* and 300*b* can also be controlled in accordance with the flow of control operation illustrated in FIGS. 6 and 7, and the same effect can be obtained.

A structure in which switching of the junction claws 300*a* and 300*b* is controlled with the driving source was described above. The direction to which a paper is guided can be switched even with a structure including no driving source. The following describes an exemplary structure thereof, with reference to FIG. 5.

Figure 5:
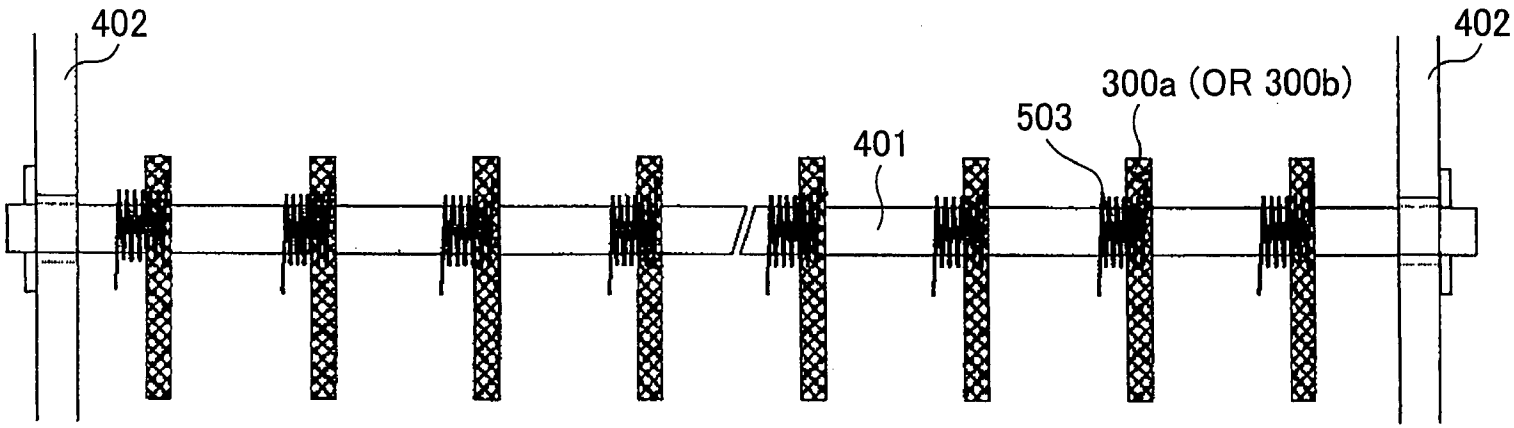
FIG. 5 is an explanatory diagram illustrating a structure in which a junction claw included in the image forming apparatus illustrated in FIG. 1 is switched without using a driving source.

FIG. 5 differs from the structure of FIG. 4 in which the shaft 401 is rotatably supported by the device casing 402. Instead, in FIG. 5, the shaft 401 is supported (held) by the device casing 402, and the junction claws 300*a* or 300*b* are rotatably supported by the shaft 401. A coil spring 503 is attached to the junction claws 300*a* or 300*b*, and the junction claws 300*a* or 300*b* are pressed in one direction by the coil spring 503. Further, though not illustrated, the junction claws 300*a*, 300*b* are positioned at a predetermined place by the force of the coil spring 503. Such positioning is shown, for example, by the position illustrated in FIG. 3(*a*).

The force (elasticity) of the coil spring 503 is set at such a level that the junction claws are rotated by a paper being transported. Therefore, when a paper is transported through the first transport path 301 as illustrated in FIG. 3(*a*), the junction claws 300*b* are pushed by the front end of the paper and are rotated against the coil spring 503 as illustrated in FIG. 3(*b*). When the rear end of the paper passes the junction claws 300*b*, the junction claws 300*b* automatically come back to the position illustrated in FIG. 3(*a*) by the force of the coil spring 503.

With the above structure, it becomes unnecessary to control switching of the junction claws 300*a* or 300*b* with the driving source. Moreover, because the junction claws 300*a*, 300*b* are switched by the force of the paper being transported, the paper is accurately guided to the intended transport path, preventing, for example, paper jam. Therefore, since it is not necessary to use the driving source, control of the driving source becomes unnecessary. This simplifies the structure, and therefore the whole apparatus is simplified.

In the structure of switching the junction claws illustrated in FIG. 3, junction claws 300*a* are disposed on the second transport path 303 (transport path 116) that guides a paper supplied from the manual paper-supply section 8. The junction claws 300*a* are optional. For example, the first transport path 301 and the second transport path 303 guide a paper in the same direction to the junction of the reversed-paper transport path 302. Therefore, in FIG. 3, the transport path of a paper from the reversed-paper transport path 302 is substantially orthogonal to the first transport path 301 and the second transport path 303. This may cause a paper transported through the reversed-paper transport path 302 to be undesirably guided to the first transport path 301 or the second transport path 302. Therefore, junction claws 300*b* need to be disposed.

On the other hand, the second transport path 303 is in the substantially same direction as the first transport path 301. Therefore, a paper transported through the second transport path 303 is guided to the reversed-paper transport path 302, not to the second transport path 301. Further, a paper transported through the first transport path 301 is also guided to the reversed-paper transport path 302, not to the first transport path 303. Therefore, by disposing junction claws 300*b* for switching transport paths at the junction of the reversed-paper transport path 302, paper jam can be prevented and the paper can be accurately guided to the intended transport path.

As described above, a paper feeder of the present invention is installed on a side of an image forming apparatus. Further, the paper feeder includes a plurality of paper storing sections that are vertically disposed. The paper feeder includes paper outgoing apertures that respectively correspond to the plurality of paper storing sections. A plurality of inlet openings are provided on the image forming apparatus, corresponding to the paper outgoing apertures. The paper outgoing apertures are disposed at positions where a paper from a paper storing section is transported substantially maintaining a posture the paper had when the paper was stored. One of the paper outgoing apertures is disposed at a position that corresponds to an inlet opening of the paper transport path for the manual paper-supply section provided in the image forming apparatus.

Further, one of the paper outgoing apertures is disposed correspondingly to a junction to a reversed-paper transport path provided for performing double-sided printing in the image forming apparatus.

Further, a junction claw for switching a transport path is disposed at a junction to the reversed-paper transport path for performing double-sided printing in the image forming apparatus and the transport path from the paper feeder. The junction claw constitutes a part of the reversed-paper transport path for performing double-sided printing. The junction claw is rotated by the driving source at a timing when a paper is supplied from the paper feeder, so as to transport the paper from the paper feeder to the reversed-paper transport path provided for performing double-sided printing. Further, the junction claw constitutes a part of the reversed-paper transport path provided for performing double-sided printing. The junction claw is rotated with the front end of a paper being transported from the paper feeder, and transports the paper from the paper feeder to the reversed-paper transport path provided for performing double-sided printing.

The present invention provides the following effects.

A paper is transported with less bending and curves. As a result, paper jam or skewed transporting of papers can be prevented.

Further, the reversed-paper transport path provided for performing double-sided printing in the image forming apparatus can be efficiently utilized as a paper transporting path. Therefore, no additional transport path needs to be provided. As a result, growth in size of the image forming apparatus can be avoided.

Further, in a paper feeder of the present invention, one of the plurality of paper outgoing apertures may be disposed at a position corresponding to the paper transport path for the paper-supply section provided in the image forming apparatus when the paper feeder is not used by the image forming apparatus.

The present invention is not limited to the description of the embodiments above, but may be altered by a skilled person within the scope of the claims. An embodiment based on a proper combination of technical means disclosed in different embodiments is encompassed in the technical scope of the present invention.

What is claimed is:

1. A paper feeder that includes a plurality of paper storing sections supplying a paper to an image forming apparatus, comprising:

a plurality of paper outgoing apertures, respectively corresponding to the plurality of paper storing sections, for transporting a paper to the image forming apparatus, wherein one of the plurality of paper outgoing apertures is disposed at a position corresponding to a supplied-paper transport path disposed in the image forming apparatus and used for transporting a paper from a paper-supply section within the image forming apparatus to a paper transport path, and another one of the plurality of paper outgoing apertures is disposed at a position corresponding to a reversed-paper transport path provided for performing double-sided printing in the image forming apparatus.

2. The paper feeder as set forth in claim 1, further comprising paper transport pats, respectively connecting the paper storing sections and the paper outgoing apertures, for transporting a paper without changing a posture the paper had when the paper was sent from a paper storing section.

3. The paper feeder as set forth in claim 1, wherein the plurality of paper storing sections are vertically disposed on one another, the plurality of paper outgoing apertures, respectively corresponding to the plurality of paper storing sections, are opened on one side of a device casing and are vertically disposed on one another in accordance wit an order in which the plurality of paper storing sections are disposed in a vertical direction, and paper transport paths are disposed that connect the plurality of paper storing sections to the respective outgoing apertures.

4. An image forming apparatus comprising:

a paper feeder which includes:

a plurality of paper storing sections supplying a paper to the image forming apparatus, and a plurality of paper outgoing apertures, respectively corresponding to the plurality of paper storing sections, for transporting a paper to the image forming apparatus;

inlet openings disposed at positions respectively corresponding to the plurality of paper outgoing apertures;

a manual paper-supply section disposed above the paper feeder; and a first transport path for transporting a paper from the manual paper-supply section to the image forming apparatus, the first transport path being disposed in such a way as to merge into a second transport path through which a paper from a paper storing section disposed at a top of the paper feeder is sent to the image forming apparatus, wherein the second transport path merges into a reversed-paper transport path after the first transport path merges into the second transport path.

5. An image forming apparatus comprising:

a paper feeder which includes:

a plurality of paper storing sections supplying a paper to the image forming apparatus, and a plurality of paper outgoing apertures, respectively corresponding to the plurality of paper storing sections, for transporting a paper to the image forming apparatus;

inlet openings disposed at positions respectively corresponding to the plurality of paper outgoing apertures;

a paper storing section;

an image formation processing section;

a paper transport path that passes through the image formation processing section;

a supplied-paper transport path that connects the paper storing section to the paper transport path;

a reversed-paper transport path having one end connected to the paper transport path downstream of the image formation processing section and another end connected to the paper transport path upstream of the image formation processing section, and is disposed on one side of a device casing with respect to the paper transport path;

an inlet opening opened on one side of the device casing; and an incoming transport path having one end connected to the reversed-paper transport path and another end connected to the inlet opening, the inlet opening being disposed at a position corresponding to one of the plurality of paper outgoing apertures provided in the paper feeder, wherein the paper transport path downstream of the image formation processing section includes an ejection roller that rotates in a first direction to eject an individual paper to an ejection tray and rotates in a second direction, opposite to the first direction, to loop the individual paper back through the reversed-paper transport path.

6. An image forming apparatus comprising a paper feeder which includes:

a plurality of paper storing sections supplying a paper to the image forming apparatus; and a plurality of paper outgoing apertures, respectively correspondingly to the plurality of paper storing sections, for transporting a paper to the image forming apparatus, one of the plurality of paper outgoing apertures disposed at a position corresponding to a reversed-paper transport path provided for performing double-sided printing in the image forming apparatus, said image forming apparatus comprising:

the reversed-paper transport path;

an incoming transport path, having one end connected to the reversed-paper transport path and another end accepting a paper sent from one of the plurality of paper outgoing apertures of the paper feeder, so as to transport the paper to the reversed-paper transport path;

a junction claw, provided at a junction of the reversed-paper transport path and the incoming transport path, for switching the transport paths; and a switching driving section for the junction claw, and a control section that controls an operation of the switching driving section, wherein the control section controls the switching driving section in such a way that the junction claw is switched at a timing when a paper is supplied from the paper feeder, so as to guide the paper from the paper feeder to the reversed-paper transport path.

7. An image forming apparatus, comprising:

an image former including an image formation processing section that forms an image on paper; and a paper feeder including a plurality of paper storing sections for supplying the paper to the image former and which are stacked in a top-to-down direction, the image former and the paper feeder being disposed next to each other, the paper feeder having paper outgoing apertures that respectively correspond to the plurality of paper storing sections and are positioned to respectively correspond to heights of the corresponding paper storing sections, and the image former including:

a paper feeding cassette below the image formation processing section;

a first paper transport path for transporting paper from the paper feeding cassette to the image formation processing section, the first paper transport path being disposed to extend in a top-to-bottom direction in a vicinity of the paper feeder;

a reversed-paper transport path for turning over paper, the reversed-paper transport path being disposed between an upper part of the first paper transport path and the paper feeder, extending in a top-to-bottom direction, and having an upper end section and a lower end section both connected to the first paper transport pat; and paper inlet openings formed in that side of the image former on which the paper feeder is disposed, the paper inlet openings respectively facing the paper outgoing apertures, where the paper inlet opening facing an uppermost paper outgoing aperture of the paper outgoing apertures is a first paper inlet opening, and the paper inlet opening facing a lower paper outgoing aperture located below the uppermost paper outgoing aperture is a second paper inlet opening, wherein the first paper inlet opening is connected, via a second paper transport path, to that position in the reversed-paper transport path which corresponds to a height of the first paper inlet opening, and the second paper inlet opening is connected, via a third paper transport path, to that position in the first paper transport path which corresponds to a height of the second paper inlet opening.

8. The image forming apparatus as set forth in claim 7, further comprising:

a manual paper-supply section disposed above the paper feeder; and a paper transport path for transporting paper from the manual paper-supply section to the image former, the paper transport path merging into the second paper transport path.

* * * * *